US005462612A

United States Patent [19]

Morita et al.

[11] Patent Number: 5,462,612

[45] Date of Patent: Oct. 31, 1995

[54] AIRTIGHT ALUMINUM ALLOY CASTING AND ITS MANUFACTURING METHOD

[75] Inventors: Shigetaka Morita; Yoshio Igarashi, both of Minamikawachi; Masanao Suzuki, Kanda, all of Japan

[73] Assignee: Hitachi Metals, Ltd., Tokyo, Japan

[21] Appl. No.: 217,700

[22] Filed: Mar. 25, 1994

[30] Foreign Application Priority Data

Mar. 26, 1993 [JP] Japan ..... 5-067806

[51] Int. Cl.[6] ..... C22C 21/02; C22B 21/00

[52] U.S. Cl. ..... 148/439; 148/438; 148/437; 75/684

[58] Field of Search ..... 75/684; 148/438, 148/439, 437

[56] References Cited

U.S. PATENT DOCUMENTS 3,816,952 6/1974 Niebyski et al. ..... 75/684

OTHER PUBLICATIONS

Rombauer et al., Joy of Cooking, 1975, The Bobbs-Merrill Company, Inc., pp. 336–369.

*Primary Examiner*—Deborah Yee

*Attorney, Agent, or Firm*—Sughrue, Mion, Zinn, Macpeak & Seas

[57] ABSTRACT

An aluminum alloy casting comprising 4.0 to 13.0% of Si, 4.5% or below of Cu, 1.5% or below of Mg, and the rest of Al in weight ratio is produced by a production method which adds a metallic hydride to a molten aluminum alloy for casting at a temperature of liquidus line or above. This method makes the shape of pores generated in the casting circular and fine, and an average crystal grain diameter to be ⅓ or below of a thickness of the casting, thereby, an aluminum alloy casting having excellent airtightness can be produced.

7 Claims, 4 Drawing Sheets

AIRTIGHT ALUMINUM ALLOY CASTING AND ITS MANUFACTURING METHOD

FIELD OF THE INVENTION

This invention relates to an aluminum alloy casting having excellent airtightness to be used as intake parts for automobiles, and to a method thereof.

BACKGROUND OF THE INVENTION

When aluminum alloy is melted to be cast as an aluminum alloy product, pores are often formed within a casting due to hydrogen gas or shrinkage. Where such a casting is used as parts such as passages or containers for gas, leakage might be caused through such parts due to communication of pores or shrinkage cavities within the casting. If defects within the casting, even if they are pores due to hydrogen gas or shrinkage, are present independently, leakage through such parts does not take place.

Pores, which are formed within an aluminum alloy casting obtained by a common casting method such as gravity casting or low pressure casting, are present in grain boundaries 5 of crystal grains 1 as shown in FIG. 5. In addition, as shown in FIG. 5, pores are not circular and when the grain size is large, pores 3*a* and 3*b* are easily communicated.

When an aluminum alloy casting having pores of the aforementioned shape is used for intake system parts for automobiles such as a manifold and a collector whose inside and outside pressures are different, intake air may leak outside, resulting in the possibility of deteriorating engine performance. Therefore, various measures, e.g. a gassing treatment for removing hydrogen gas from the molten aluminum alloy, have been taken to prevent pores due to hydrogen gas from occurring.

When casting is made from the degassed molten aluminum alloy, however, formation of non-circular pores is surely reduced, but shrinkage cavity occurs conversely in thick wall portions at an area where wall thickness varies largely. For example, when shrinkage cavity 10 occurs at boss 7 of a manifold or a collector as shown in FIG. 6, a tapping process to the boss 7 communicates its interior and outside, resulting in the leakage of intake air outside.

Therefore, conducting the gassing treatment to prevent the occurrence of pores due to hydrogen gas leads to another defect in the casting, and it is difficult to stably obtain an aluminum alloy casting having excellent airtightness.

To remedy such a drawback, Japanese Patent Publication No. 5-65573 discloses an aluminum alloy for casting which prevents the occurrence of shrinkage cavities due to Fe impurities and has excellent airtightness by adding 0.001 to 0.01 wt % of Ca to an Al-Si-Mg system or Al-Si-Mg-Cu system alloy.

But, even if the shrinkage cavities are reduced by adding Ca, the shrinkage cavities have a non-circular shape, possibly resulting in communicating pores. Therefore, using an aluminum alloy casting having such pores for intake system parts for automobiles still has problems.

Additionally, Japanese Patent Application Laid-open Print No. 5-98379 discloses an aluminum alloy which is used for automobile intake system parts such as a manifold. This aluminum alloy containing 4.0 to 10.0% of Si, 4.5% or below of Cu, 0.5% or below of Mg, and the rest of Al and inevitable impurities in weight ratio, has the aspect ratio of pores (length of pore/breadth of pore) reduced, has the area rate of pores (generation rate of pores) reduced, and has the correlation of the aspect ratio and the pore area rate fixed within a certain range, thereby preventing the leakage due to pores from occurring at thin wall portions near thick wall portions.

The above application controls the generation rate of pores and the aspect ratio indicating the generation form of pores but does not solely control pores themselves.

As a method to prevent shrinkage cavities from occurring in the thick wall portions of a casting, hydrogen is added to molten metal to disperse shrinkage cavities. Hydrogen dissolved in the molten aluminum has its solubility sharply reduced when the molten aluminum solidifies, so that hydrogen is gasified into bubbles as shown by the following formula to leave fine pores behind in an aluminum alloy casting. Thus, it is known that hydrogen is effective to relieve shrinking due to solidification and to disperse shrinkage cavities into fine pores.

Formula: 2H (dissolution)$\rightarrow H_2$ (gas)

To add hydrogen to the molten aluminum, a method which has been used heretofore is dipping potato or water-soaked cloth into the molten metal to utilizes the decomposition of water as shown by the following formula.

Formula: $2Al+3H_2O \rightarrow Al_2O_3+6H$ (dissolution)

Particularly, potato, which contains an appropriate amount of water, is often used because workability is excellent.

But, this method generates oxide of aluminum as shown in the above formula, producing a large quantity of slag. Therefore, work for raking out the slag is required. And, because of the inclusion of the oxide into the molten metal, a casting obtained from this molten metal contains a large quantity of film oxides, deteriorating the strength. Additionally, the film oxides induce the generation of gas, so that pores have long shapes to easily communicate with one another and to degrade airtightness.

Japanese Patent Publication No. 51-44084 discloses a method for producing a porous aluminum alloy in which quick solidification of the molten aluminum is prevented, 1–25% of magnesium is added to be dissolved to control the size of crystal grains, and titanium hydride generating gas at a temperature less than a liquidus line and above a solidus line of the alloy is added and stirred in order for bubbling and the improvement of viscosity. According to this publication, an aluminum alloy casting having bubbling property is obtained. The porosity of bubbling is approximately 30 to 60%, and the size of pores is about 0.05 to 0.20 mm.

But, the above aluminum alloy has an excessively large porosity, lacks in airtightness, and has insufficient mechanical strength, so that it cannot be used for automobile intake system parts.

SUMMARY OF THE INVENTION

This invention aims to provide an aluminum alloy casting excellent in airtightness and free from defects such as shrinkage in thick wall portions by adding hydrogen without oxidizing to the molten aluminum alloy to generate dispersed pores.

Another object of this invention is to provide an aluminum alloy casting having superior airtightness and free from defects such as shrinkage in thick wall portions by specifying the shape and size of pores to prevent them from being communicated to one another.

Further, this invention aims to provide an aluminum alloy casting excelling in airtightness by controlling a ratio of crystal grain diameter and thickness of the aluminum alloy casting to form many grain boundaries thereby, making pores fine to prevent them from being communicated.

The aluminum alloy casting of this invention comprises 4.0 to 13.0% of Si, 4.5% or below of Cu, 1.5% or below of Mg and the rest of Al and impurities in weight ratio, and is characterized by increasing an average circularity of pores and decreasing an average circle equivalent diameter of the pores. The pores become round and fine as the average circularity is larger and the average circle equivalent diameter is smaller.

The aluminum alloy casting of this invention has 1 to 6 mm of thickness at thin portion, 0.6 or above of the average circularity, and 300 micrometers of the average circle equivalent diameter.

The aluminum alloy casting of this invention further contains at least one of 0.03 to 0.20 wt % of Ti and 10 to 100 ppm of B, and its average crystal grain diameter is ⅓ or below of the thickness of the casting.

Additionally, the aluminum alloy casting of this invention contains 50 to 700 ppm of strontium (hereinafter referred to as "St").

And, the aluminum alloy casting of this invention contains 0.3 to 0.9 ppm of hydrogen.

DETAILED DESCRIPTION OF THE INVENTION

Figure 1:
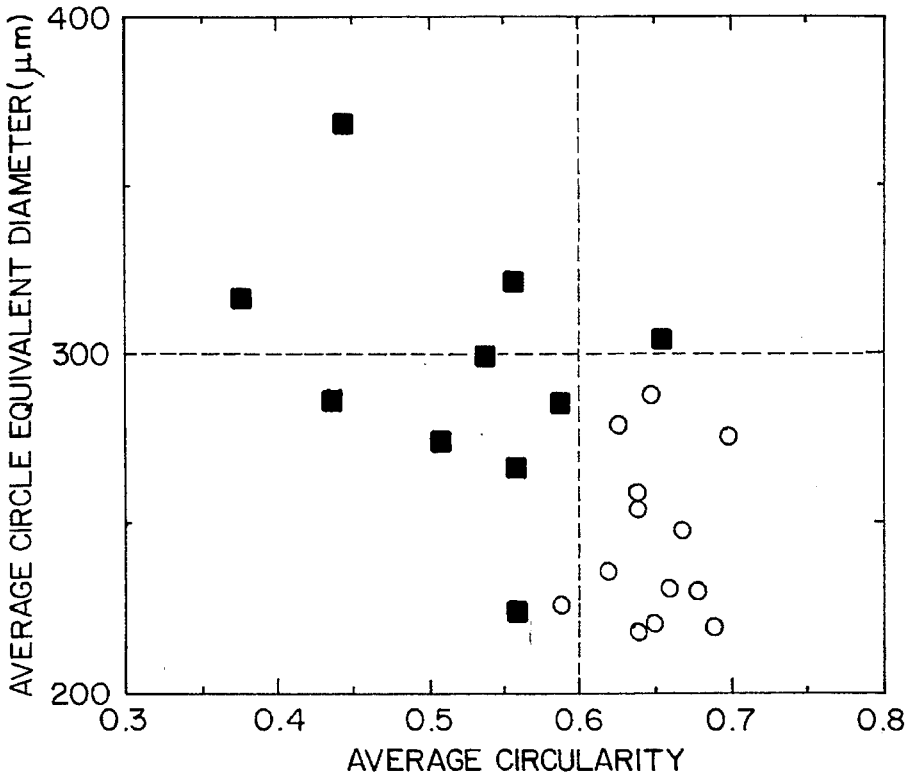
FIG. 1 is a diagram showing the relation between the average circularity and average circle equivalent diameter of pores generated in an aluminum alloy casting and the occurrence of leakage in an airtightness test.

As a result of observing sectional portions where leakage has occurred in various aluminum alloy castings, it has been found that an aluminum alloy casting having excellent airtightness can be obtained when pores formed in the casting are made to be circular and small as much as possible and Sr or hydrogen is added in an appropriate amount, so that pores are not communicated even if they are generated within the aluminum alloy casting.

It has also been found that an aluminum alloy casting having excellent airtightness can be obtained when an average crystal grain diameter with respect to a thickness of the aluminum alloy casting is less than a certain level, because the occurrence of pores in the aluminum alloy casting does not lead to the communication of pores.

The aluminum alloy casting of this invention comprises 4.0 to 13.0% of Si, 4.5% or below of Cu, 1.5% or below of Mg and the rest of Al and impurities in weight ratio and is characterized by increasing an average circularity and decreasing an average circle equivalent diameter of the pores.

The average circularity is a value to represent roundness of pores, and defined as an average value of a ratio of a pore area with respect to an area of a circle with circumference having the same length with the circumference length of a pore, and expressed as follows:

Average circularity=pore area/area of a circle with circumference having the same length with the circumference length of a pore, and falls in a range of 0 to 1 (maximum value of 1 in case of complete circle). And, the average circle equivalent diameter is a value to represent fineness of pores, and defined as an average value of a diameter of a circle having the same area with that of a pore.

Pores become round and fine as the average circularity is larger and the average circle equivalent diameter is smaller, so that the pores are not communicated to one another, and the interior and exterior of the aluminum alloy casting are not readily communicated.

When a thickness at thin portion of the aluminum alloy casting is 1 to 6 mm, it is preferable that the average circularity is 0.6 or above, and the average circle equivalent diameter is 300 micrometers.

When the above values are met, pores are not communicated and the interior and exterior of an aluminum alloy casting are not easily communicated even if the casting has different internal and external pressures.

And, in the aluminum alloy casting of this invention, Sr content is preferably 50 to 700 ppm.

By containing 50 to 700 ppm of Sr in the aluminum alloy casting, eutectic Si is made fine, and mechanical properties can be improved. And, Sr is effective to disperse shrinkage to prevent shrinkage cavity . When the content of Sr is less than 50 ppm, effects of making eutectic Si fine and dispersing shrinkage are decreased. On the other hand, when the content of Sr exceeds 700 ppm, the improvement of effects is not expected, and it is economically disadvantageous. Therefore, the content of Sr is preferably in a range of 50 to 700 ppm.

Furthermore, the aluminum alloy casting of this invention contains 0.3 to 0.9 ppm of hydrogen.

By containing 0.3 to 0.9 ppm of hydrogen in the aluminum alloy casting, shrinkage is dispersed and pores become circular. By the presence of hydrogen gas, pores are generated in the dispersed state, shrinkage cavity is prevented from generating in thick portions, and at the same time, hydrogen gas is dispersed in pores which are generated in the dispersed state, so that the pores become circular. As a result, in comparison with a casting having non-circular pores, pores are prevented from being communicated, and mechanical properties are improved. When the content of hydrogen is less than 0.3 ppm, effects of dispersing shrinkage and making pores circular are little even if pores are generated. On the other hand, when the content of hydrogen exceeds 0.9 ppm, remarkable improvement of effects cannot be expected.. Therefore the content of hydrogen is in a range of 0.3 to 0.9 ppm. More preferably, it is 0.3 to 0.6 ppm.

Furthermore, the aluminum alloy casting of this invention comprises 4.0 to 13.0% of Si, 4.5% or below of Cu, 0.5% or below of Mg, at least one of 0.03 to 0.20% of Ti and 10 to 100 ppm of B and the rest of Al and impurities in weight ratio, and its average crystal grain diameter is ⅓ or below of its thickness.

The smaller the crystal grains becomes, the more the grain boundary increases. In many cases, the pores in an aluminum alloy casting are generated in the grain boundary, so that the more the grain boundary increases, the more the pores are generated, each pore becomes fine and eventually, pores are not easily communicated. The average crystal grain diameter is measured by observing through a macro-etch. If the ratio of an average crystal grain diameter and a thickness of a casting (average crystal grain diameter/casting thickness) is expressed as a wall thickness ratio, when the wall thickness ratio exceeds ⅓, since crystal grains are only one to three in the wall thickness direction, pores generated in the grain boundary become large and are communicated, leading to ready leakage. But, when the wall thickness ratio is ⅓ or below, crystal grains are available three or more in the wall thickness direction, pores become relatively small and are not communicated, and leakage can be prevented.

When 0.03 to 0.20% of Ti is contained in weight ratio, the crystal grains in the aluminum alloy casting are made fine. When Ti is less than 0.03 wt. %, the effect of making the crystal grains fine is not good. On the other hand, when the content of Ti exceeds 0.20 wt. %, coarse compounds are crystallized, and mechanical properties are deteriorated. Therefore, the content of Ti is in a range of 0.03 to 0.20% in weight ratio.

The crystal grains in the aluminum alloy casting are made fine by containing 10 to 100 ppm of B. When the content of B is less than 10 ppm, its effect is less, and when its content exceeds 100 ppm, its effect is not greatly improved, and it is economically disadvantageous. Therefore, the content of B is in a range of 10 to 100 ppm.

The aluminum alloy casting having excellent airtightness of this invention is useful as intake system parts such as a manifold and a collector, and as covers and containers such as a valve locker cover and a timing chain case.

A method for producing the aluminum alloy casting having excellent airtightness of this invention is characterized by adding metallic hydride into the molten aluminum alloy for casting at a temperature of liquidus line or above.

Since the metallic hydride has properties to release hydrogen according to the increase of a temperature as it is used as a hydrogen occlusion alloy, adding it to the molten aluminum at about 700° C. makes it possible to add hydrogen as expressed by the following formula. When hydrogen is added by the metallic hydride, gas contained in the aluminum alloy casting is dispersed into fine pores, and since the metallic hydride substantially does not contain oxygen, the aluminum alloy casting is not oxidized.

Formula: $MH \rightarrow M+H$ (where, M=metal)

As the metallic hydride, $TiH_2$, $Mg_2NiH_2$, $MgH_2$, etc. may be used.

Using titanium hydride ($TiH_2$) is particularly preferable as the titanium hydride is a compound of hydrogen and titanium which has functions to make aluminum alloy crystal grains very fine and to improve mechanical strength. It is preferable to add 0.001 to 0.10% of titanium hydride in weight ratio to the molten aluminum alloy.

When the content of titanium hydride is less than 0.001 wt %, it is not effective to generate pores, and when it exceeds 0.10 wt %, pores are increased, and airtightness and mechanical strength cannot be obtained.

The invention is now illustrated in greater detail with reference to the following specific examples and embodiments, but the present invention is not to be construed as being limited thereto.

Example 1

Figure 7:
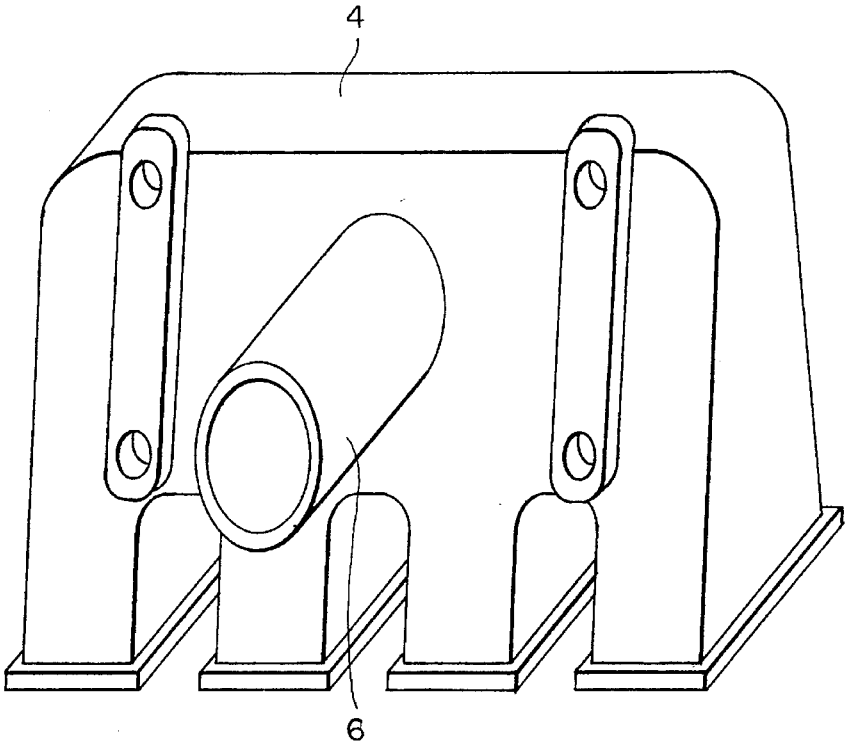
FIG. 7 shows the external shape of an intake manifold as an automobile intake system part.

Using an aluminum alloy equivalent to AC4B (JIS standard) containing 8.0% of Si, 2.7% of Cu, 0.3% of Mg and the rest of Al and impurities in weight ratio, a manifold 4, which had a thin wall thickness of 3 mm and a thick wall thickness of 20 mm, for a 1500 cc 4-cylinder engine was cast as shown in FIG. 7. In the process, Sr content and hydrogen content were variously adjusted to form various shaped pores in the casting. After casting, the manifold 4 was machined to seal its openings before immersing it under water, compressed air of 0.3 MPa was supplied therein, and leakage within and outside the manifold was investigated. Then, cross sections at portions where leakage had occurred and not occurred were polished for observation, and the shape and size of pores were measured by an image analysis device.

FIG. 1 shows the relation between the occurrence of leakage and the shape of pores. In the drawing, ○ shows that leakage has not occurred, and ■ shows that leakage has occurred. It is seen from the drawing that leakage does not easily occur when the average circularity is large and the average circle equivalent diameter is small; and leakage does not occur when the average circularity is 0.6 or more and the average circle equivalent diameter is 300 micrometers or below at a pressure of 0.3 MPa. In other words, leakage can be prevented by controlling the average circularity and average circle equivalent diameter of pores according to airtightness required.

Example 2

In an aluminum alloy equivalent to AC4B in JIS standard containing 8.0% of Si, 2.7% of Cu, 0.3% of Mg and the rest of Al and impurities in weight ratio, Sr and hydrogen were added in an amount shown in Table 1 to cast the manifold 4 shown in FIG. 7. And, the manifold 4 was machined in the same way as in Example 1 to seal its openings before immersing it under water, compressed air of 0.3 MPa was supplied therein, and leakage within and outside the manifold, the average circularity and average circle equivalent diameter of pores on a section, and tensile strength were investigated. A ratio where no leakage is observed within and outside the manifold is represented as the leakage-free ratio. The hydrogen contents were measured by a Lansley hydrogen analytical method after collecting a sample from the lower part of a casting quenched in a copper die (same is applied hereinafter). The results are shown in Table 1.

TABLE 1

| | Sr Content (ppm) | Hydrogen Content (ppm) | Average Circularity | Average Circle Equivalent Dia. (μm) | Leakage-Free Production Ratio (%) | Tensile Strength ($N/mm^2$) |
|---|---|---|---|---|---|---|
| Ex. 1 | 215 | 0.21 | 0.60 | 220 | 69 | 214 |
| Ex. 2 | 15 | 0.42 | 0.70 | 280 | 83 | 218 |

TABLE 1-continued

| | Sr Content (ppm) | Hydrogen Content (ppm) | Average Circularity | Average Circle Equivalent Dia. (μm) | Leakage-Free Production Ratio (%) | Tensile Strength ($N/mm^2$) |
|---|---|---|---|---|---|---|
| Ex. 3 | 190 | 0.43 | 0.68 | 230 | 95 | 235 |
| Comp. Ex. 1 | 25 | 0.18 | 0.51 | 310 | 11 | 192 |

In Table 1, since sample 1 containing 215 ppm of Sr has a large average circularity of 0.60 and a small average circle equivalent diameter of 220 micrometers, its leakage-free ratio is 69%, and the tensile strength is 214 $N/mm^2$.

Since sample 2 containing 0.42 ppm of hydrogen has a large average circularity of 0.70 and a small average circle equivalent diameter of 280 micrometers, its leakage-free ratio is 83%, and the tensile strength is 218 $N/mm^2$.

As sample 3 containing 190 ppm of Sr and 0.43 ppm of hydrogen has a large average circularity of 0.68 and a small average circle equivalent diameter of 230 micrometers, its leakage-free ratio is 95%, and the tensile strength is 235 $N/mm^2$.

On the other hand, since comparative example 1 having small Sr and hydrogen contents has a small average circularity of 0.51 and a large average circle equivalent diameter of 310 micrometers, its leakage-free ratio is inferior to be 11%, and the tensile strength is low to be 192 $N/mm^2$.

Example 3

Using an aluminum alloy equivalent to AC4B in JIS standard containing 8.0% of Si, 2.7% of Cu, 0.3% of Mg and the rest of Al and impurities in weight ratio, the manifold 4 was cast with the appearance identical with FIG. 7 while a wall thickness at thin portions changed to 5 mm. Ti and B contents were adjusted so that various average crystal grain diameters could be obtained during the casting. After casting, the manifold 4 was machined to seal its openings 6 before immersing it under water, compressed air of 0.3 MPa was supplied therein, and leakage within and outside the manifold 4 was investigated. Then, sections at various parts of the manifold were polished, etched with sodium hydroxide, and macro structure was measured for crystal grain size (same is applied hereinafter). The results are shown in Table 2.

TABLE 2

| | Ti Content (wt. %) | B Content (ppm) | Average Grain Dia. (mm) | Wall Thickness Ratio $\left(\frac{\text{Average Grain Dia.}}{\text{Thickness}}\right)$ | Leakage-Free Production Ratio (%) | Tensile Strength ($N/mm^2$) |
|---|---|---|---|---|---|---|
| Ex. 4 | 0.05 | 5 | 1.63 | 0.33 | 64 | 214 |
| Ex. 5 | 0.16 | 5 | 1.45 | 0.29 | 66 | 218 |
| Ex. 6 | 0.02 | 15 | 1.66 | 0.33 | 61 | 209 |
| Ex. 7 | 0.02 | 90 | 1.41 | 0.28 | 77 | 221 |
| Ex. 8 | 0.16 | 90 | 1.02 | 0.20 | 95 | 233 |
| Comp. Ex. 2 | 0.02 | 5 | 2.37 | 0.47 | 19 | 203 |
| Comp. Ex. 3 | 0.28 | 5 | 1.49 | 0.30 | 69 | 163 |

In Table 2, sample 4 containing 0.05 wt. % of Ti has an average crystal grain diameter of 1.63 mm (wall thickness ratio of 0.33) and an leakage-free ratio of 64%.

Sample 5 containing 0.16 wt. % of Ti has a smaller average crystal grain diameter of 1.45 mm (wall thickness ratio of 0.29), and an leakage-free ratio has improved to 66%.

Sample 6 containing 15 ppm of B has an average crystal grain diameter of 1.66 mm (wall thickness ratio of 0.33) and an leakage-free ratio is 61%.

Sample 7 containing 90 ppm of B has a smaller average crystal grain diameter of 1.41 mm (wall thickness ratio of 0.28), and an leakage-free ratio has improved to 77%.

Sample 8 containing 0.16 wt. % of Ti and 90 ppm of B has the smallest average crystal grain diameter of 1.02 mm (wall thickness ratio of 0.20), and an leakage-free ratio has improved to 95%.

It is seen from the above results that a wall thickness ratio of samples 4 to 8 having a high leakage-free ratio is 0.33 or below, or an average crystal grain diameter is ⅓ or below of a wall thickness.

On the other hand, in comparative example 2, an average crystal grain diameter is 2.37 mm with respect to a wall thickness of 5 mm, a wall thickness ratio is 0.47, and an leakage-free ratio is low to 19%.

And, comparative example 3 having a large Ti content of 0.28 wt. % shows an leakage-free ratio of 69% but a tensile strength is low because coarse compounds were crystallized.

Example 4

In the same way as in Example 3, using an aluminum alloy equivalent to AC4B in JIS standard containing 8.0% of Si, 2.7% of Cu, 0.3% of Mg and the rest of Al and impurities in weight ratio, the manifold 4 having a wall thickness at thin portions of 3 mm shown in FIG. 7 was cast. Ti and B contents were adjusted so that various average crystal grain diameters could be obtained during the casting. After casting, the manifold 4 was machined to seal its openings 6 before immersing it under water, compressed air of 0.3 MPa was supplied therein, and leakage within and outside the manifold 4 was investigated. Then, sections of the manifold were polished to measure a crystal grain size. The results are shown in Table 3.

TABLE 3

| | Ti Content (wt. %) | B Content (ppm) | Average Grain Dia. (mm) | Wall Thickness Ratio ( Average Grain Dia. / Thickness ) | Leakage-Free Production Ratio (%) | Tensile Strength ($N/mm^2$) |
|---|---|---|---|---|---|---|
| Ex. 9 | 0.05 | 5 | 1.00 | 0.33 | 61 | 218 |
| Ex. 10 | 0.17 | 5 | 0.88 | 0.29 | 63 | 220 |
| Ex. 11 | 0.02 | 18 | 1.01 | 0.33 | 63 | 215 |
| Ex. 12 | 0.02 | 94 | 0.92 | 0.30 | 76 | 225 |
| Ex. 13 | 0.17 | 94 | 0.77 | 0.25 | 92 | 237 |
| Comp. Ex. 4 | 0.02 | 5 | 1.44 | 0.48 | 11 | 206 |
| Comp. Ex. 5 | 0.30 | 5 | 1.49 | 0.30 | 64 | 159 |

Figure 2:
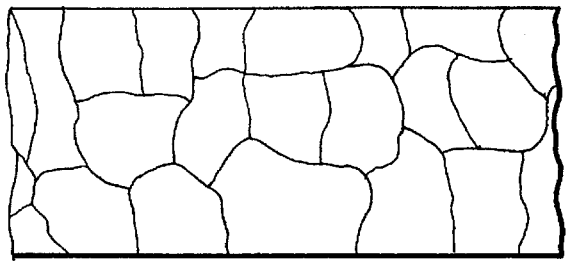
FIG. 2 shows a state of crystal grains in the cross sectional interior of the aluminum alloy casting of this invention.
Figure 3:
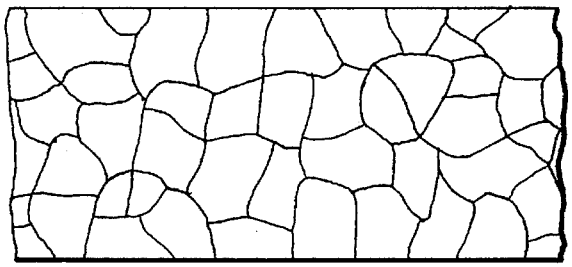
FIG. 3 shows a state of crystal grains in the cross sectional interior of the aluminum alloy casting of this invention.
Figure 4:
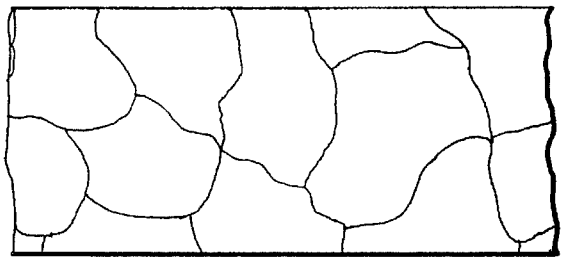
FIG. 4 shows a state of crystal grains in the cross sectional interior of the aluminum alloy casting of a comparative example.
Figure 5:
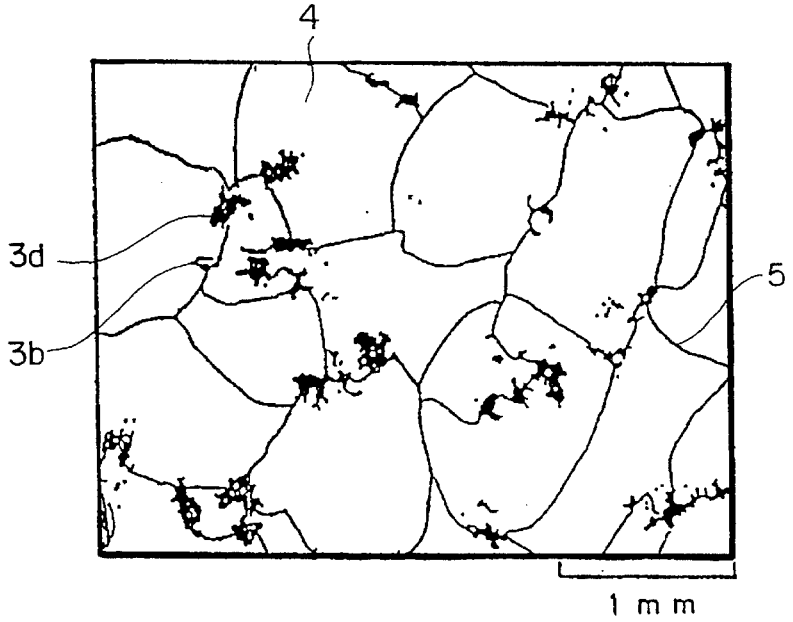
FIG. 5 shows pores generated in an aluminum alloy casting.
Figure 6:
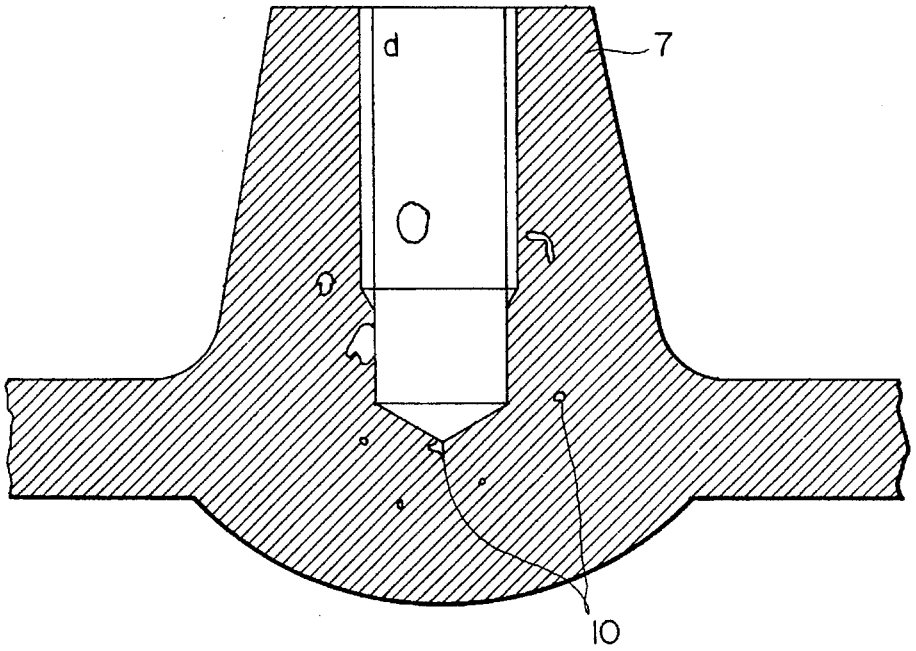
FIG. 6 is a sectional view showing a state of shrinkage generated in a boss of an automobile intake system part.

FIG. 2 and FIG. 3 show the states of crystal grains on sections of the aluminum alloy castings of sample 9 and sample 13. According to the drawings, there formed three or more of crystal grains in thickness direction. On the other hand, according to FIG. 4 showing the state of crystal grains on a section of comparative example 4, three or less of crystal grains are formed.

Since the aluminum alloy casting having a wall thickness of 3 mm shown in Table 3 has a faster cooling velocity than that having a wall thickness of 5 mm shown in Table 2, its average crystal grain diameter is generally small. Comparative example 4 has a smaller average crystal grain diameter than comparative example 2 of Table 2, but its wail thickness ratio of 0.48 is far greater than ⅓, so that an leakage-free ratio is low to 11%.

In the same way as Example 3, samples 9 and 10 to which Ti was added have a small average crystal grain diameter, and a wall thickness ratio is ⅓ or below, so that their leakage-free ratios are 61% and 63%, respectively. On the other hand, comparative example 5 which contains 0.30% of Ti has an leakage-free ratio of 64%, but tensile strength is deteriorated because coarse compounds were crystallized.

Samples 11 and 12 to which B is added have a small average crystal grain diameter, a wall thickness ratio is ⅓ or below, and leakage-free ratios are 63% and 76%, respectively.

Furthermore, sample 13 which contains 0.17 wt. % of Ti and 94 ppm of B has the smallest average crystal grain diameter of 0.77 mm (wall thickness ratio of 0.25), and an leakage-free ratio has improved to 92%.

It is clear from the above that a casting having a wall thickness of 3 mm has a high leakage-free ratio when an average crystal grain diameter is ⅓ or below of the wall thickness.

Example 5

Ten (10) kg of AC4B alloy in JIS standard was melted in a graphite crucible and kept at 700° C., and 0.001% to 0.10% in weight ratio of titanium hydride ($TiH_2$) was added thereto. Then, casting was made in a copper die to produce a sample.

Table 4 shows the hydrogen and oxygen contents and occurrence of slag of castings prepared from molten metal without $TiH_2$, molten metal with $TiH_2$ added, and molten metal with potato added in one and same copper die.

The oxygen content was measured by analyzing samples collected from the lower part of the castings with a fused infrared absorbing method in inert gas.

TABLE 4

| | Added Agent | Added Amount (wt. %) | Hydrogen Content (cc/100 g) | Oxygen Content (%) | Slag Occurrence |
|---|---|---|---|---|---|
| Before addition | — | — | 0.18 | 0.002 | — |
| Ex. 14 | $TiH_2$ | 0.001 | 0.24 | 0.002 | nil |
| Ex. 15 | $TiH_2$ | 0.002 | 0.29 | 0.002 | nil |
| Ex. 16 | $TiH_2$ | 0.004 | 0.41 | 0.002 | nil |
| Ex. 17 | $TiH_2$ | 0.006 | 0.52 | 0.002 | nil |
| Ex. 18 | $TiH_2$ | 0.010 | 0.54 | 0.002 | nil |
| Ex. 19 | $TiH_2$ | 0.090 | 0.63 | 0.002 | nil |
| Comp. Ex. 6 | Potato | 0.05 | 0.52 | 0.006 | Enormous |

It is seen from samples 14 to 19 that the molten aluminum alloy to which $TiH_2$ is added has its hydrogen content increased as compared with one to which $TiH_2$ is not added. Hydrogen can be added when 0.001% of $TiH_2$ is added. Since it is known from the past experience that about 0.3 cc/100 g or more of hydrogen in a molten aluminum alloy is effective to disperse shrinkage cavity, an amount of $TiH_2$ to be added is preferably 0.002 wt % or more.

On the other hand, about 0.5 cc/100 g of hydrogen can be added by adding potato as in comparative example 6, but a large amount of slag is produced. After removing the slag, oxygen contained in comparative example 6 has increased to 0.006% from 0.002% which is the initial value before the addition of potato. Therefore, it is considered that oxides in the molten metal has also increased to about three times. On the other hand, the addition of $TiH_2$ does not increase oxygen at all, and the occurrence of slag is substantially nil.

Example 6

AC4B alloy (JIS standard) was melted in a graphite crucible and kept at 700° C., and 0.010 wt % of titanium hydride ($TiH_2$) was added thereto. From this molten metal, 100 manifolds 4 having a wall thickness at thin portions of 5 mm shown in FIG. 7 were cast.

The openings of the manifolds 4 were sealed before immersing under water, and an air pressure of 0.3 MPa was supplied therein to inspect the occurrence of leakage. As a result, all 100 manifolds are free from leakage, good in airtightness, and excellent as intake system parts.

Figure 8:
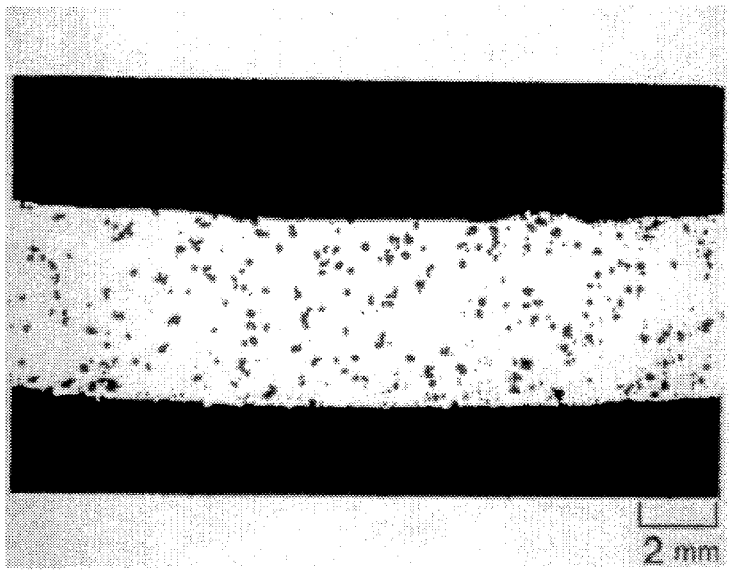
FIG. 8 shows a state of occurrence of pores in the aluminum alloy casting of this invention.
Figure 9:
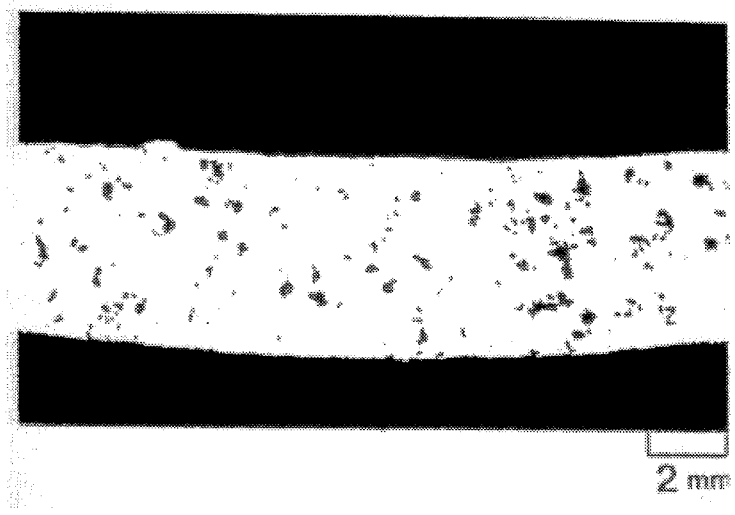
FIG. 9 shows a state of occurrence of pores in the aluminum alloy casting which has undergone a gassing treatment by adding potato.

FIG. 8 shows the states of pores on a section at a wall thickness of 5 mm, pores are fine spherical because film oxides are not many. On the other hand, FIG. 9 shows the states of pores on a section at a wall thickness of 5 mm of the casting formed from the molten metal with potato added of comparative example 6 in Example 5, and it is seen that the pores are large, long and slender because film oxides are many.

In the above example, titanium hydride ($TiH_2$) was used as a metallic hydride, but another metallic hydride may be used to obtain the same effect.

As described above in detail, the aluminum alloy casting of this invention has its pores generated to have a large average circularity and a small average circle equivalent diameter, and Sr and hydrogen are appropriately added. Therefore, even if pores are generated in the casting, pores are not communicated to one another because they are almost sphere and exist independently. Thus, even if this casting is used for a portion where internal and external pressures are different, leakage does not occur, and defects such as shrinkage do not occur in a thick wall portion, and mechanical strength is improved.

And, this invention can provide an aluminum alloy casting by making an average crystal grain diameter to be ⅓ or below of a wall thickness, so that pores are made fine and not communicated to one another.

The method for producing the aluminum alloy casting having excellent airtightness of this invention can add hydrogen by adding a metallic hydride to the molten aluminum alloy at a temperature of liquidus line or above without oxidizing the molten metal, does not need to rake out the slag, does not increase oxides, and can disperse shrinkage cavities into fine pores.

The aluminum alloy casting having excellent airtightness of this invention is useful as automobile intake system parts such as a manifold and a collector.

What is claimed is:

1. An airtight aluminum alloy casting comprising 4.0 to 13.0% of Si, 4.5% or less of Cu, 1.5% or less of Mg, and the rest of Al in weight ratio, wherein the aluminum alloy casting further comprises 0.3 to 0.9 ppm of hydrogen and at least one of 0.03 to 0.20 wt. % of Ti and 10 to 100 ppm of B, a wall thickness of 1 to 6 mm at thin portions of the aluminum alloy casting, and pores in the aluminum alloy casting having an average circularity of 0.6 or more and average circle equivalent diameter of 300 μm or less.

2. The airtight aluminum alloy casting according to claim 1, further comprising strontium in a range of 50 to 700 ppm.

3. The airtight aluminum alloy casting according to claim 1, wherein the aluminum alloy casting is an intake system part.

4. The airtight aluminum alloy casting according to claim 3, wherein the intake system part is a manifold.

5. The airtight aluminum alloy casting according to claim 3, wherein the intake system part is a collector.

6. A method for producing the airtight aluminum alloy casting comprising the steps of adding a titanium hydride to a molten aluminum alloy for casting, wherein the molten aluminum alloy comprises 4.0 to 13.0% of Si, 4.5% or less of Cu, 1.5% or less of Mg, and the rest of Al in weight ratio, at a temperature of a liquidus line or higher.

7. The method for producing the airtight aluminum alloy casting according to claim 6, wherein 0.001% to 0.10% weight ratio of the titanium hydride is added to the molten aluminum alloy.

* * * * *